United States Patent [19]

Wyant

[11] Patent Number: 4,681,240

[45] Date of Patent: Jul. 21, 1987

[54] TOWELLING PACKAGE

[76] Inventor: James A. Wyant, 321 Lanthier Ave. #409, Pointe Claire, Quebec, Canada, H9S 5K6

[21] Appl. No.: 808,072

[22] Filed: Dec. 12, 1985

[51] Int. Cl.[4] ..... A47K 10/24

[52] U.S. Cl. ..... 221/48; 221/302

[58] Field of Search ..... 221/47, 48, 55, 63, 221/64, 302

[56] References Cited

U.S. PATENT DOCUMENTS

| | | | |
|---|---|---|---|
| 3,235,165 | 2/1966 | Jackson | 221/63 |
| 3,369,699 | 2/1968 | Enloe et al. | 221/48 |
| 4,131,195 | 12/1978 | Worrell | 221/63 |
| 4,156,493 | 5/1979 | Julius | 221/63 |
| 4,411,374 | 10/1983 | Hotchkiss | 221/47 |
| 4,550,855 | 11/1985 | Harrison | 221/63 |
| 4,574,952 | 3/1986 | Majui | 221/48 |

*Primary Examiner*—H. Grant Skaggs

*Attorney, Agent, or Firm*—Larson and Taylor

[57] ABSTRACT

A dispensing package comprising a stack of folded, interleaved paper towels and a plastic wrapper enclosing the stack of towels. A dispensing slit is provided in the wrapper through which the towels are manually dispensed one at a time. Each towel pulls the next towel part-way out of the wrapper through the slit. A layer of adhesive, on the outer surface of the wrapper adjacent the slit, holds each next towel in its partly withdrawn position, ready for use.

2 Claims, 4 Drawing Figures

TOWELLING PACKAGE

This invention is directed toward a package of interleaved sheets.

The invention is more particularly directed toward an improved dispensing package of interleaved sheets.

Dispensing packages of interleaved sheets, such as sheets of tissue, are well known. The package is provided with a top opening through which the sheets are manually pulled out, one at a time, as needed. As one sheet is pulled out for use, it pulls the next interleaved sheet part-way out of the package, through the opening, ready to be used next. The opening in the package is sized and/or shaped so as to have its defining edges frictionally hold this next sheet in its partly-withdrawn position where it is readily accessible to be gripped and completely pulled out of the package when needed.

In another embodiment, the top of the package can be provided with a special panel containing the opening, and with friction increasing means on the panel adjacent the opening. The friction increasing means can comprise a specific coating, or a roughened portion on the upper surface of the panel. An example of such a package is shown in Canadian Pat. No. 839,560 issued April 21, 1970, to Kimberly-Clark Corp. The embodiment in this patent is meant to be employed in packages having sheets where the frictional force exerted by the edges of the opening is not sufficient alone to hold the sheets in a partly-withdrawn position.

However, the employment of a special frictional holding surface on the dispensing package increases its cost. In addition, the known special frictional holding surfaces still cannot prevent certain sheets, such as heavy paper towels, from falling back through the opening into the package.

Applicant's invention is directed toward an improved dispensing package for interleaved sheets that is relatively inexpensive yet capable of dispensing relatively heavy sheets without having the sheets fall back into the package. Applicant's invention is particularly suited to an inexpensive dispensing package of paper towels. Packages of paper towels are employed in the dairy industry. The towels are used to wipe the udders of cows before milking. The towels are packaged inexpensively in a plastic wrapper and dispensed through a top opening in the wrapper. However the heavy towels often fall back through the opening into the package and must be fished out with difficulty through the opening when needed.

In accordance with applicant's invention, the fallback problem is minimized by providing an adhesive on the outer surface of the wrapper adjacent the opening. Each towel pulled partly out of the package sticks to the adhesive and thus is prevented from falling back into the package. The adhesive on the wrapper is provided as part of a cover means for the opening in the package. A slit in the wrapper, forming the opening, is initially closed with a cover strip. The cover strip is attached to the wrapper with a layer of special adhesive to form the cover means. The adhesive layer remains on the wrapper, adjacent the slit, when the cover strip is removed to use the package. The adhesive also remains tacky, thus providing a gripping surface for the sheets to retain them in a partly-withdrawn position when pulled part-way out of the wrapper.

Applicant's invention provides a simple, inexpensive, towel dispensing package. The package is easily opened for use by peeling off the adhesively attached cover strip. The adhesive employed to attach the cover strip is also then used to prevent the sheets from falling back into the package during dispensing. No other special frictional means are necessary.

The invention is particularly directed toward a dispensing package comprising a stack of interleaved sheets. and a wrapper enclosing the stack. Means are provided in the wrapper for forming a dispensing opening therein for use in manually removing the sheets from within the wrapper one at a time. Adhesive means are also provided on the outer surface of the wrapper, adjacent the opening. The adhesive means releasably retain a towel, pulled part-way out of the package by a previously used towel, in its partly-withdrawn position, ready for use.

The invention will now be described in detail having reference to the accompanying drawings in which.

Figure 1:
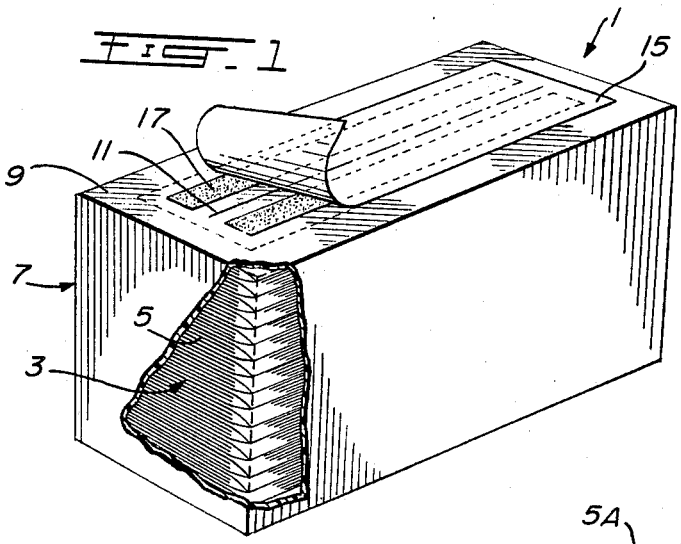
FIG. 1 is a perspective view of the dispensing package before use.
Figure 2:
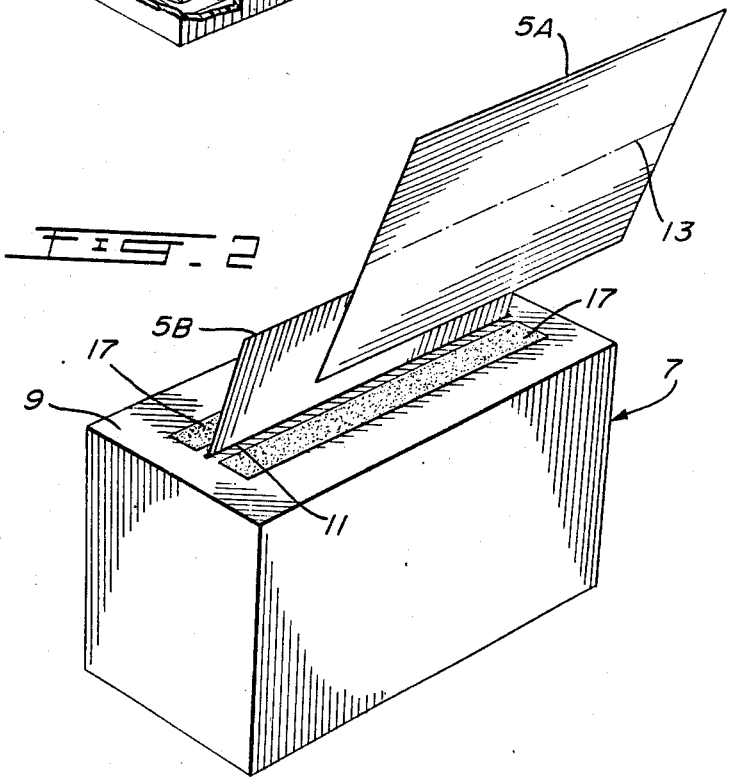
FIG. 2 is a perspective view of the dispensing package during use.
Figure 3:
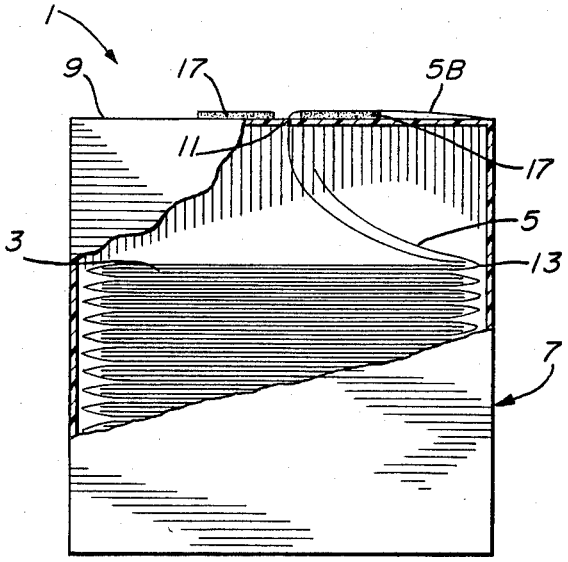

FIG. 3 an end view of the package during use; and

Figure 4:
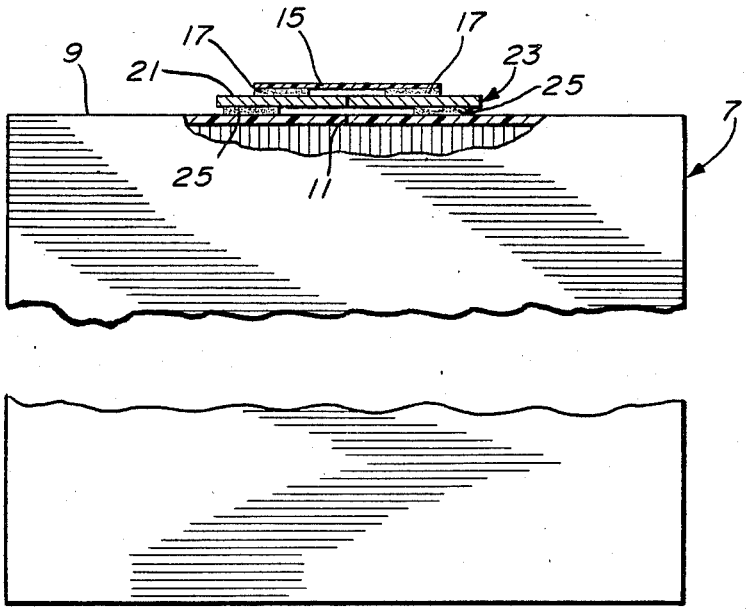

FIG. 4 is an end view of another embodiment of the package during use.

The dispensing package 1, as shown in the drawings, comprises a stack 3 of disposable towels 5 enclosed by a wrapper 7. The towels 5 are folded and interleaved in a manner so that when one towel 5A is withdrawn from the package 1 for use, it pulls the next towel 5B partially out of the package 1, ready to be used next. The towels 5 are preferably paper towels. The wrapper 7 preferably is made from a suitable plastic material such as polyethylene.

A dispensing opening is formed in the top 9 of the wrapper 7 for use in removing the towels 5 from within the wrapper. The opening comprises a slit 11 generally centrally located on the top 9 of the wrapper and extending almost completely across the package top 9 in a direction parallel with the fold lines 13 in the towels. The slit 11 can be preformed in the package. Alternatively, a line of perforations (not shown) can be formed in the wrapper during manufacture. When ready for use, the line of perforations can be opened up to form slit 11. The same effect could also be achieved by replacing the line of perforations with a line of weakness (not shown). The line of weakness is broken open to form a slit 11 when the package is to be used.

The slit 11, and the immediate area of the outer surface of top 9 of the wrapper 7 surrounding the slit 11, are initially covered with a flexible strip 15 of material. The cover strip 15 closes the package 1 until use. The cover strip 15 is attached to the wrapper 7 with adhesive. The adhesive can be applied in a layer 17 on the wrapper. The adhesive is of the type that stays tacky when exposed. A suitable adhesive is an Ethylene Vinyl Acetate Copolymer such as is sold by Swift Canadian Co. Limited under their trade mark CZ 12-050. The cover strip 15 itself is made from suitable paper or plastic material.

When the package is to be used, the cover strip 15 is peeled off the top 9 of the wrapper 7, exposing slit 11. At least a portion of the adhesive layer 17, releasably holding the cover strip 15 to the wrapper, remains on the top 9 of the wrapper 7, on either side of, and adjacent, the slit 11. The top towel 5A is then withdrawn from the wrapper 7 through the slit 11 for use. As the towel 5A is withdrawn from the wrapper 7, it also pulls the next towel 5B part-way out of the wrapper through slit 11. This next towel 5B falls across the tacky adhesive layer 17, as shown in FIG. 3, which layer holds the towel and prevents it from slipping back through the slit into the wrapper. Thus the next towel 5B is held in an accessible position ready for use. The towel user does not have to fish inside the wrapper, through the slit, to pull out the next towel.

In an alternative embodiment, as shown in FIG. 4, the adhesive layer 17 can be applied on the top surface 21 of a carrier strip 23. The carrier strip 23 itself is non-detachably attached, via its bottom surface, with an adhesive layer 25 to the top 9 of the wrapper 7. The slit 11 is formed through both the center of the carrier strip 23 and the top 9 of the wrapper 7. The slit 11 is covered, as before, with cover strip 15 releasably attached to the adhesive layer 17 on the carrier strip 23. When the cover strip 15 is removed, slit 11 is exposed as is the tacky adhesive 17 on each side of slit 11. Towels partially pulled out of the wrapper, adhere to adhesive 17, so as to avoid falling back into the wrapper.

In a further embodiment of the package, the adhesive layer 17, the cover strip 15, and the carrier strip 23 if used, can be positioned adjacent the slit 11, or the means forming the slit, instead of covering the slit. This positions the adhesive layer 17 on one side or the other of the slit 11, but closely adjacent to it to hold a paper towel extending part-way out of the package. If desired, two adhesive layers 17, two cover strips 15, and two carrier strips 23 if used, can be positioned one on each side of the slit 11, or the means forming the slit. This positions an adhesive layer 17 on each side of the slit.

The embodiments of the invention in which an exclusive property or privilege is claimed are defined as follows:

1. A dispensing package for paper towels, comprising:

a stack of interleaved paper towels;

a wrapper enclosing the stack of towels and having a substantially flat top;

a towel dispensing slit extending in an approximate straight line in the approximate center of the top of the wrapper for use in manually removing the towels from within the wrapper one at a time;

two tacky adhesive layer strips on the outer surface of the top of the wrapper extending substantially parallel to the slit and for the same length as the slit, the adhesive layer strips located one on each side of the slit in a position to leave a narrow space on the outer surface of the top of the wrapper between the slit and each of the adhesive layer strips, one of the two adhesive layer strips releasably retaining a towel that is pulled part way out of the wrapper by a previously dispensed towel and that falls over the top of the wrapper thereby preventing the towel from falling back within the wrapper, the adhesive layer strips positioned relative to the slit to retain the towel by its fallen-over, horizontal portion rather than by any vertical portion of the towel extending down within the wrapper, and a removable cover sheet extending over the slit and the two adhesive layer strips, initially releasably held to the outer surface of the top of the wrapper by the two adhesive layer strips to cover the slit and protect the two adhesive layer strips.

2. The dispensing package according to claim 1 including a carrier strip non-removably attached to the outer surface of the top of the wrapper, the towel dispensing slit and the two adhesive layer strips located on the carrier strip.

* * * * *